US005617919A

United States Patent [19]

Saucier

[11] Patent Number: 5,617,919

[45] **Date of Patent: *Apr. 8, 1997**

[54] GRAVEL-PACKING APPARATUS AND METHOD

[76] Inventor: Randolph J. Saucier, 8088 Winners Cir., Mandeville, La. 70448

[ * ] Notice: The term of this patent shall not extend beyond the expiration date of Pat. No. 5,443,121.

[21] Appl. No.: 517,530

[22] Filed: Aug. 21, 1995

Related U.S. Application Data

[63] Continuation-in-part of Ser. No. 264,724, Jun. 23, 1994, Pat. No. 5,443,121.

[51] Int. Cl.[6] ..... E21B 43/04; E21B 43/08

[52] U.S. Cl. ..... 166/278; 166/51; 166/205

[58] Field of Search ..... 166/51, 74, 236, 166/205, 278, 296

[56] References Cited

U.S. PATENT DOCUMENTS

| | | | |
|---|---|---|---|
| Re. 34,451 | 11/1993 | Donovan et al. . | |
| 3,726,343 | 4/1973 | Davis, Jr. . | |
| 3,987,854 | 10/1976 | Callihan et al. | 166/278 |
| 4,270,608 | 6/1981 | Hendrickson et al. . | |
| 4,295,524 | 10/1981 | Baker et al. . | |
| 4,635,725 | 1/1987 | Burroughs . | |
| 4,856,591 | 8/1989 | Donovan et al. . | |
| 4,880,059 | 11/1989 | Brandell et al. . | |
| 4,991,654 | 2/1991 | Brandell et al. . | |
| 5,016,716 | 5/1991 | Donovan et al. . | |
| 5,067,568 | 11/1991 | Yates, Jr. et al. . | |
| 5,076,355 | 12/1991 | Donovan et al. . | |
| 5,261,486 | 11/1993 | Cornette et al. . | |
| 5,330,003 | 7/1994 | Bullick . | |
| 5,355,948 | 10/1994 | Sparlin etal. | 166/228 |
| 5,409,061 | 4/1995 | Bullick | 166/278 |

*Primary Examiner*—Frank Tsay

*Attorney, Agent, or Firm*—Rosenblatt & Redano, P.C.

[57] ABSTRACT

A gravel-packing apparatus and method is disclosed which involves a movable sleeve over a screen. The screen is fixed to a packer downhole while the sleeve is operated from the surface. As the sleeve is lifted to expose more of the screen, the granular material deposits along the outside of the screen and through the exposed perforations, starting from the packer and working its way up. The annulus is sealed by multiple cup seals or other suitable seals for the environment so that the slurry pressure applied from the surface is directed to deposition of the granular material adjacent the exposed perforations. As more granular material is deposited, the crew at the surface may further pull the sleeve up or the developed pressure downhole itself can force the sleeve further up, exposing additional perforations and continuing the deposition process of the granular material. At the conclusion of the operation, the outer sleeve is removed and the screen is left in place for subsequent production from the gravel-packed perforations. Later, if desired, the gravel screen may be retrieved from the wellbore. The shifting sleeve may be a solid member with external seals against the casing to temporarily obstruct some of the perforations. In the alternative, the sliding sleeve may be an inflatable member with built-in seals. A flow restriction may be placed in the washpipe-screen annulus flow path to improve the development of downhole pressure and cause the sleeve to rise automatically. Packing diaphragms may be provided with or without the flow restriction to assist annular packing.

20 Claims, 5 Drawing Sheets

GRAVEL-PACKING APPARATUS AND METHOD

FIELD OF THE INVENTION

This is a continuation in part of application Ser. No. 08/264,724 filed on Jun. 23, 1994, now U.S. Pat. No. 5,443,121.

The field of the invention relates to an apparatus and method for improved gravel packing for downhole applications.

BACKGROUND OF THE INVENTION

Gravel packing is a term known in the oil and gas business which involves, in one class of applications, the placement of a granular material outside of casing perforations to improve the performance of the well by causing the formation material to be constrained, thus allowing formation fluids better access to the tubing string and ultimately to the surface. In the past this has been accomplished by placing a screen in the appropriate location and pumping down, in slurry form, a fluid bearing the granular material it would deposit. Problems have ensued with this procedure pumping the material from above the top of the perforated interval creates a potential for bridges and blocks to form uphole, which in turn prevent adequate and thorough high-density packing and distribution of the granular material out, across, and around the entire perforated interval and length of the screen. Incomplete packing of the casing-screen annulus, perforations, and areas outside of the perforated casing are well-known causes of sand control failure and/or poor gravel-packed well productivity. Such incomplete packing is the result of efforts to pack a lengthy interval where significant differences in perforation injectivity prevent packing of all perforations.

The apparatus and method of the present invention address this potential faulty distribution and packing problem by providing a technique to pack within and outside of the perforated interval and outside of the screen systematically in smaller segments from the bottom up. With the technique of the present invention, the risk of bridging or blocking at the upper end, precluding adequate distribution at the lower end, is greatly reduced if not eliminated. Additionally, by packing smaller segments systematically, the problem of incomplete perforation packing is reduced if not eliminated. Thus, a more efficient and effective gravel-pack job can be accomplished with the apparatus.

Accordingly, it is an object of the present invention to facilitate thorough distribution of the granular material around a screen and within and outside of the perforated interval by virtue of deposition of the granular material around the screen and perforated interval from the bottom up. It is also an object of the present invention to improve performance of wells by providing a more efficient and productive gravel pack for the well operator.

SUMMARY OF THE INVENTION

A gravel-packing apparatus and method is disclosed which involves a movable sleeve over a screen. The screen is fixed to a packer downhole while the sleeve is operated from the surface. As the sleeve is lifted to expose more of the screen, the granular material deposits along the outside of the screen and through the exposed perforations, starting from the packer and working its way up. The annulus is sealed by multiple cup seals or other suitable seals for the environment so that the slurry pressure applied from the surface is directed to deposition of the granular material adjacent the exposed perforations. As more granular material is deposited, the crew at the surface may further pull the sleeve up or the developed pressure downhole itself can force the sleeve further up, exposing additional perforations and continuing the deposition process of the granular material. At the conclusion of the operation, the outer sleeve is removed and the screen is left in place for subsequent production from the gravel-packed perforations. Later, if desired, the gravel screen may be retrieved from the wellbore. The shifting sleeve may be a solid member with external seals against the casing to temporarily obstruct some of the perforations. In the alternative, the sliding sleeve may be an inflatable member with built-in seals. A flow restriction may be placed in the screen forming a restricted washpipe-screen annulus to improve the development of downhole pressure and cause the sleeve to rise more readily and/or automatically. Packing diaphragms may be provided with or without the flow restriction to assist annular packing and further facilitate automatic rising of the sleeve.

DETAILED DESCRIPTION OF THE INVENTION

Figure 1:
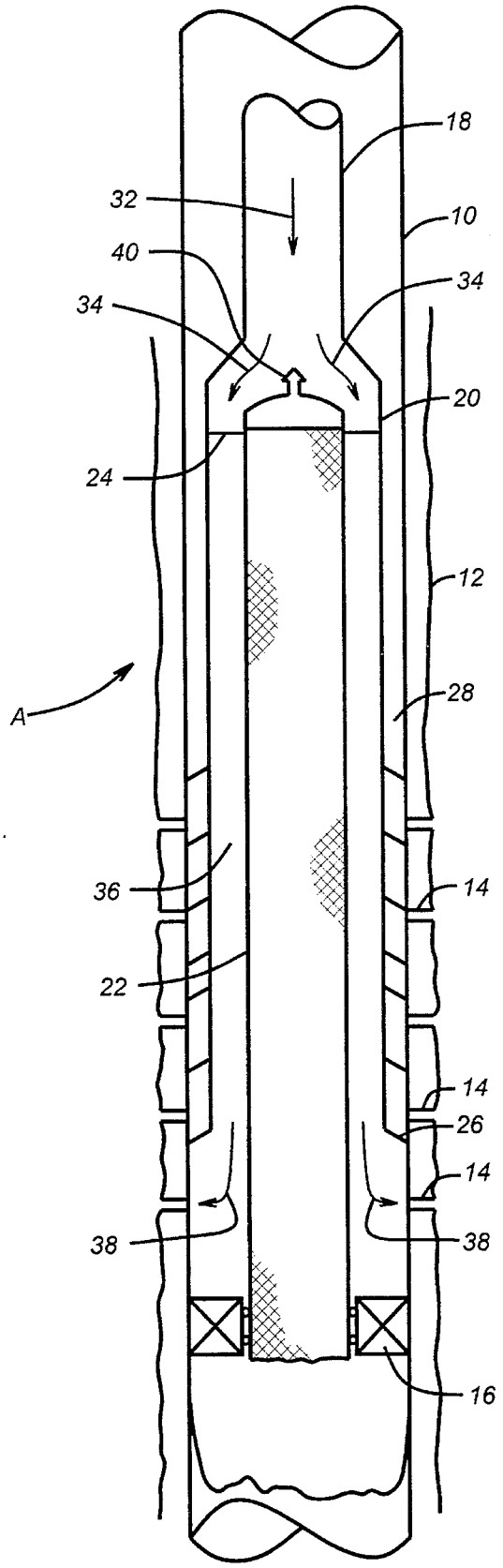
FIG. 1 illustrates a preferred embodiment of the apparatus and method of the present invention in a sectional elevational partly schematic view.

The apparatus A is illustrated in FIG. 1. A casing 10 has been cemented using cement 12 and perforated to make the perforations 14. In the preferred embodiment, the perforations 14 in the casing 10 may be made with a burr-free perforator, or in the alternative the perforations 14 are scraped internally at the casing 10 to remove burrs and other rough or jagged edges.

A packer 16 is set in the casing 10 in the usual manner, well-known in the art. The tubing string, represented schematically as 18, is lowered into casing 10 to the area adjacent the perforations 14. During run-in, a sleeve 20 is disposed at the lower end of string 18. Disposed within and extending out below sleeve 20 is screen 22. A connection mechanism 24 of a type well-known in the art is provided at the base of screen 22 to allow selective engagement with packer 16. Once the screen 22 is anchored to packer 16, which is already engaging the casing 10, the method of the present invention can be initiated.

Mounted on the outside of sleeve 20 is an aggregation of cup-shaped seals 26 sufficient to span the perforated interval. While an aggregation of cup seals 26 in series is preferred over other seals, other seals may be incorporated with sleeve 20 without departing from the spirit of the invention. Additionally, a single seal between screen 22 and casing 10 can be incorporated without departing from the spirit of the invention. A single seal may be a discrete seal of relatively short height compared to its radius or can be one continuous flexible member having a height substantially longer than its radius. As shown in FIG. 1, a stack of seals 26 seals the annular space 28 and isolates the upper perforations 14 from those disposed below the lowermost seal 26 during the gravel-packing procedure.

Screen 22 can be temporarily supported by sleeve 20 or tubing string 18 by the connection mechanism 24 when it is anchored to packer 16. At that time an upward pull or a combination of movements can be applied to the tubing string 18 to obtain release of sleeve 20 from screen 22. One type of attachment can be a shear pin or pins 30 (see FIG. 6). A mechanical assembly (e.g., J-slot) can also be employed for the temporary fixation of the sleeve 20 to the screen 22 during the run-in position, which will allow release of the sleeve from the screen by manipulation.

The gravel-packing procedure of the present invention is initiated by pumping the granular material in a slurry down the tubing string 18, as indicated by arrow 32. The slurry goes around the screen as indicated by arrows 34. In the initial position shown in FIG. 1, the granular material travels downwardly in annular space 36 until it gets to the vicinity of the lowermost perforations 14 which are not covered up by seal or seals 26. The result is a deposition of the granular material above packer 16 through the exposed perforations, and outside of screen 22, starting from the packer 16 and moving on upwardly. As the space between the screen 22 and the exposed perforations 14 begins to fill with granular material, the operator at the surface can displace the sleeve 20 upwardly to expose additional perforations 14. Alternatively or in combination, the resulting pressure buildup above the packer 16 from deposition of the granular material, represented by arrows 38, provides a net unbalanced upward force on sleeve 20 and the tubing string 18 which could be of sufficient magnitude to assist sleeve 20 in moving upwardly when allowed to from the surface. As sleeve 20 continues its upward movement, eventually all the perforations in a given zone are exposed, starting from the lowermost and on up the hole. By placing the granular material outside the screen 22 and outside the perforations systematically from packer 16 and then moving upwardly, the problems of deposition of granular material from the top down are eliminated. The concern in the prior methods was that the granular material deposited from above the uppermost perforations could bridge, settle, form nodes, or otherwise prevent an effective deposition of granular material along the entire operative length of screen 22 and throughout the entire perforated interval.

It is contemplated by the invention that a screen 22 of a type that is well-known in the art be used. Such a screen could have a plug with a fishing neck 40 to facilitate removal after gravel pack completion, thus providing access to a screen seal bore to receive production seals on the end of production tubing.

Figures 2, 3, 4, 5:
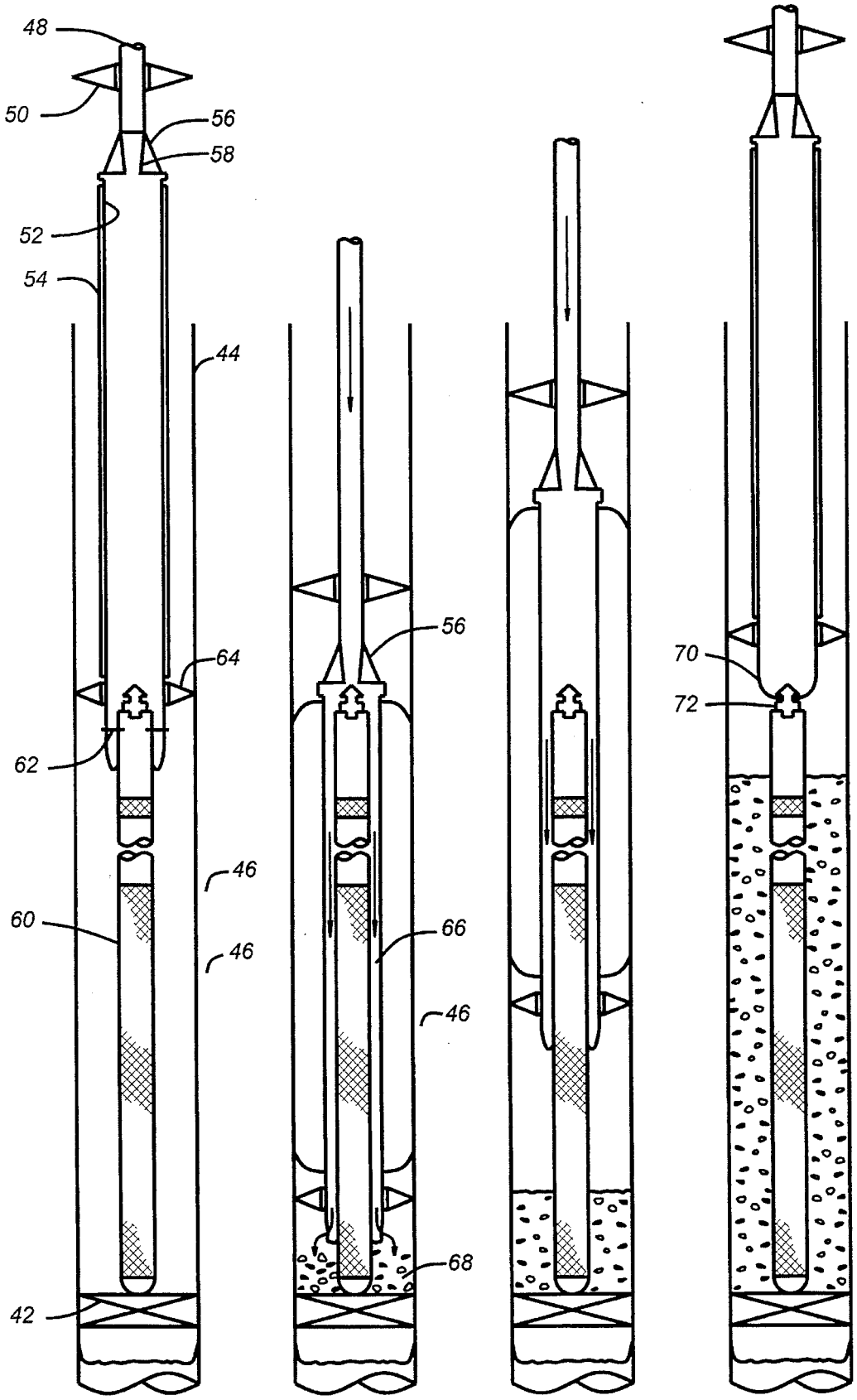
FIG. 2 is a sectional elevational schematic view of an alternative embodiment in the run-in position.
FIG. 3 is the view of FIG. 2, with the shifting sleeve inflated and granular material being delivered.
FIG. 4 is the view of FIG. 3, with the shifting sleeve in a shifted position after the onset of delivery of granular material.
FIG. 5 is the view of FIG. 3, with the packing operation concluded, showing the feature for retrieval of the screen protective plug.

FIGS. 2–5 illustrate an alternative embodiment of the present invention. In FIG. 2, the run-in position is illustrated. A packer 42 is already set in the wellbore 44. FIG. 2 illustrates that the wellbore 44 has already been perforated, by a schematic representation of the perforations 46. In the schematic representations of FIGS. 2–5, the reference to the wellbore 44 is also intended to include the presence of a cemented casing. However, the presence of a cemented casing in the vicinity of the perforations 46 is not mandatory for the operation of the apparatus A and method of the present invention.

As shown in FIG. 2, a tubing string 48, which could optionally include centralizers 50, supports a sleeve 52. Mounted outside sleeve 52 is a flexible inflatable member 54. Inflatable member 54 may be made of materials suitable to withstand the pressures and temperatures applied during use and of an appropriate wall thickness so that it can withstand sufficient pressures to remain in an inflated condition during pumping, as shown in FIG. 3, so that selected perforations 46 can be isolated. The preferred mode of inflation of inflatable member 54 is illustrated in FIG. 2. A plurality of screened ports 56 allows tubing 48 pressure to enter the inflatable member 54. A constriction 58 in the tubing 48 above the ports 56 causes sufficient pressure during pumping on the tubing to inflate the inflatable member 54. Such pressure may be created by inner flow member sizing as well. Upon supplying pressure from the surface via string 48, the fluid enters the screened openings 56 and inflates the member 54. This condition persists as long as tubing 48 pressure is applied.

Referring now to FIG. 2 in the run-in position, a screen 60 is temporarily supported to sleeve 52 by preferably a shear pin or pins 62. The screen 60 is located on bottom or stabbed into the packer 42 and anchored in the conventional manner. Thereafter, a downward force is applied to string 48 which results in breaking of pin or pins 26 and relative movement between sleeve 52 and screen 60. This can be seen by comparing FIGS. 2 and 3. Centralizers 64 may be used with the inflatable member, 54 to further assist the proper positioning of the inflatable member, 54 once it is inflated, as shown in FIG. 3.

Upon breaking of shear pin or pins 62 and proper positioning of sleeve 52, tubing pressure is applied to screened openings 56 by pumping operations, which results in inflation of inflatable member, 54. At this time, most of the perforations 46 are obstructed, as shown in FIG. 3. At this time, the granular material used for the gravel pack is pumped down tubing 48 into an annular space 66. The granular material or gravel 68 exits the annular space 66 above packer 42. At this point, the granular material 68 begins to exit the exposed perforations and pack outside the casing in a preferred manner and cover up the volume between screen 60 and exposed perforations 46. The procedure continues with upward shifting of sleeve 52, either by an upward force applied to the tubing 48 from the surface or by the developed pressure outside of screen 60 which creates an upward force on inflated inflatable member 54. Upward movement of the inflated member 54, maintaining continuous pumping, may be achieved in some cases. In the alternative, the inflatable member 54 can be allowed to become partially deflated while the repositioning occurs, whereupon the inflatable member 54 is again reinflated in a higher position where more of the perforations 46 are exposed. The process continues from the packer 42 on upwardly until all of the perforations 46 are sufficiently packed and covered with the granular material 68 and the spaces between the perforations 46 and screen 60 and within and outside of all perforations are well packed. The only remaining step at that point is to deflate the inflatable member 54 and retrieve the sleeve 52. The sleeve 52 in the preferred method will come with a fishing assembly, schematically represented as 70, which can selectively remove the protective plug from the screen top by way of a fishing neck 72 in screen 60. Removal of the protective plug exposes a seal bore within the top section of the screen assembly that can subsequently receive production seals when production tubing is run. It is unlatched from the packer 42 in the conventional manner.

Figure 6:
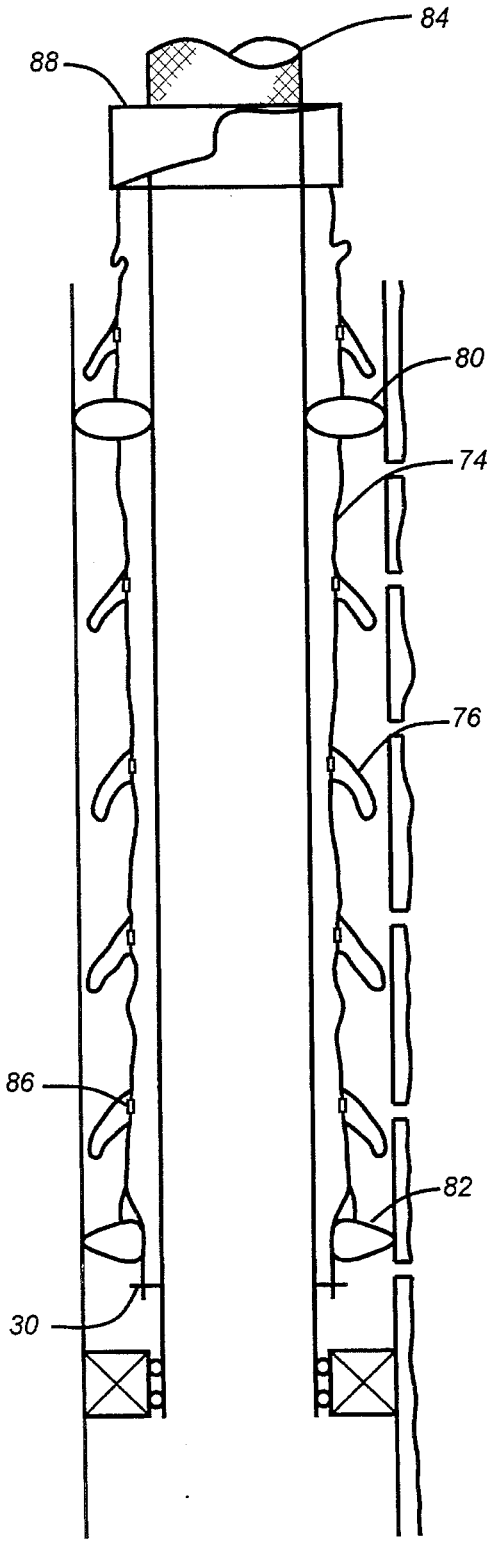
FIG. 6 is an alternative embodiment of the apparatus of FIG. 2, shown in the run-in position.
Figure 7:
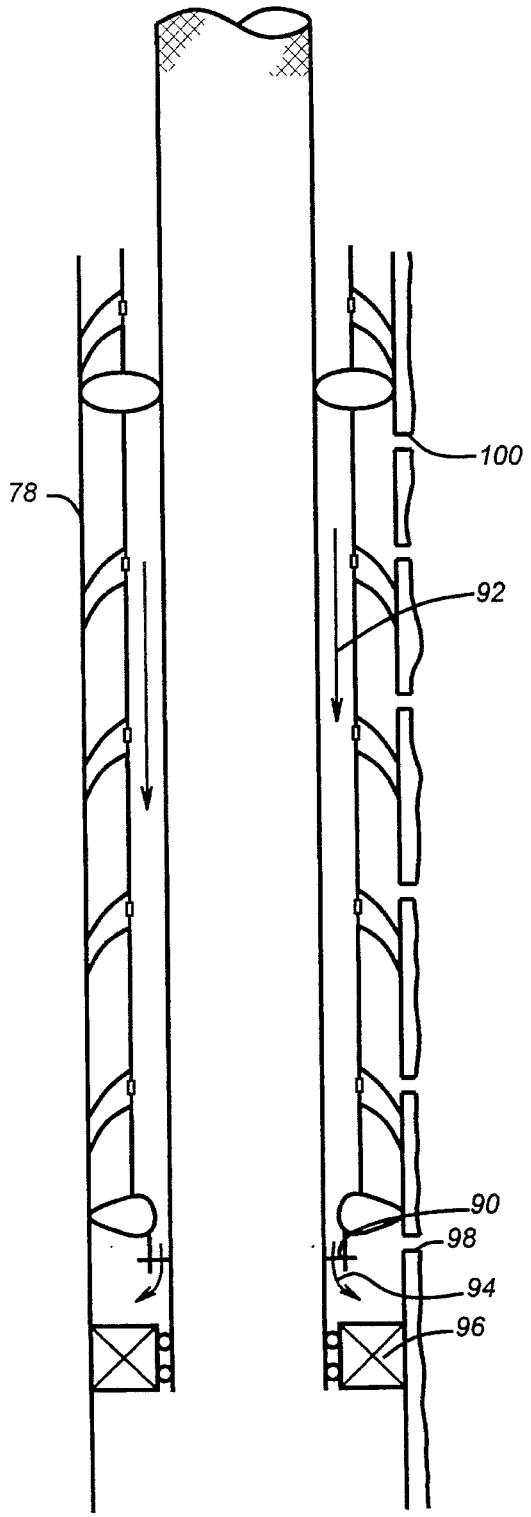
FIG. 7 is the view of FIG. 6, with the shifting sleeve in the inflated position and the granular material being placed outside the screen.

A third embodiment of the apparatus and method of the present invention is illustrated in FIGS. 6 and 7. FIGS. 6 and 7 show a different type of an inflatable member 74. This member has circumferentially extending seal elements 76. Seal elements 76 are downwardly extending in their collapsed state as shown in FIG. 6. When expanded as shown in FIG. 7, they extend outwardly into contact with the perforated casing 78. In the preferred embodiment, the seal elements 76 function like a plurality of cup seals. However, different configurations of a seal element or elements 76 may be used without departing from the spirit of the invention. Embodied in the inflatable member 74 are centralizers as illustrated by 80 and 82 spaced as required along the assembly. The inflatable member 74 is mounted over a screen 84. To facilitate inflation of each of the seal elements 76, a screened opening 86 is the entry point of fluids which enter the seal elements 76 after entering the main body of the inflatable member 74 adjacent its upper end 88. In the run-in position, the inflatable member 74 is temporarily secured to screen 84, typically by a shear pin or pins 30. A constricted opening or openings 90 create backpressure due to pumping within the inflatable assembly 74 for inflation of assemblies 74 and 76. Such pressure may also be created by inner flow member sizing as well. As shown by arrow 94, the pumped fluid with the granular material or gravel exits above the packer 96. The inner tubing or openings 90 are sized such that upon the establishment of sufficient flow with the granular material into upper end 88, a backpressure is maintained within inflatable member 74 such that it presents itself in the wellbore in the position shown in FIG. 7.

Figure 8:
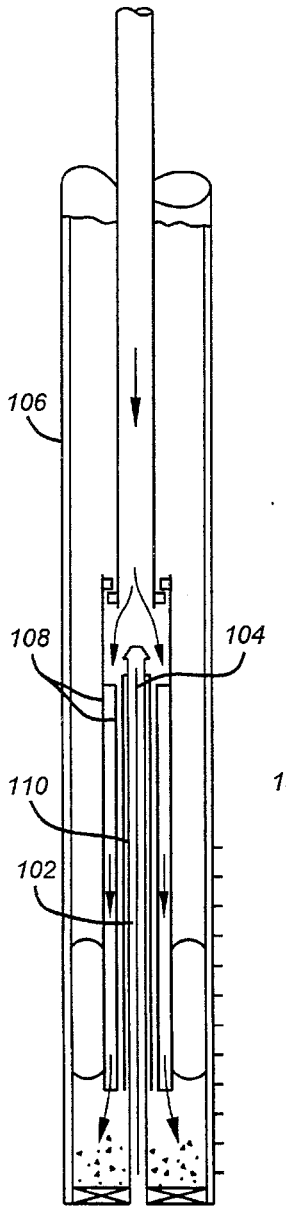
FIG. 8 is an embodiment including a washpipe and inner seals.

As shown in FIG. 8, the sleeve may be formed of two conduits 108 having different diameters, one disposed within the other. In this embodiment, the sliding sleeve 108 is not rigidly attached to the tubing but is free to rise up on the tubing as packing pressures are created beneath. Alternately, the sliding sleeve may be raised manually by raising the tubing as previously described. The annular flowpath created between the two conduits is used to conduct the slurry to the desired portion of the perforated interval. As in the other emobdiments previously described, the sleeve is preferably initially interposed between the screen and the upper portion of the perforated interval so that only those perforations in the lower portion of the interval are exposed; that is—only in the lower portion of the interval are there no obstructions between the screen and the perforations. In this and other embodiments, however, the sleeve may initially be interposed between the screen and all of the perforations in the interval.

A return flow path for fluids bearing the granular material which will be deposited in and around the perforations is unnecessary since fluid can merely be forced through the perforations, but may be provided in all embodiments. A flow restriction may be provided to reduce the cross-section of the flow path inside the screen, thereby improving the pressure developed downhole. This may be accomplished, for example, by employing a washpipe-screen annulus flow path with seals. A washpipe 104 having seals 102 may be placed inside the screen 110. The washpipe need not be functional in the conventional sense of providing a return flow path, but merely provides a mechanism for holding the seals. Seals 102 may extend completely or only partially between the washpipe and the inner diameter of the screen. If the sleeve is constructed of two conduits with the slurry flow path in between, the seals within the screen may completely obstruct the inner diameter of the screen, effectively restricting the flow path to the space between the sleeve and the screen. The washpipe may be physically (and detachably) attached to the screen or, if the washpipe seals completely obstruct the inner diameter of the screen, may be held inside the screen by a friction fit.

As the slurry is introduced and packing proceeds, the restriction in the washpipe-screen annulus flow path will contribute to the development of pressure. The pressure developed when the area around the exposed perforations is sufficiently packed provides a net unbalanced upward force on sleeve 20 and the tubing string 18 sufficient to automatically move the sleeve and tubing string upward or to move the sleeve only upward as illustrated by FIG. 8, exposing additional, higher perforations for packing. Although it is not necessary to practice the invention, a restriction in the washpipe-screen annulus flow path is recommended for all applications to improve performance. Where the restriction is a washpipe with seals, a conventional means 122 may be provided for recovering the washpipe and seals after packing is complete.

Figure 10:
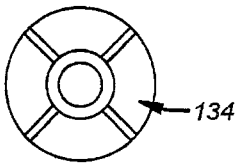
FIG. 10 is a view of a deployed packing diaphragm.
Figure 11:
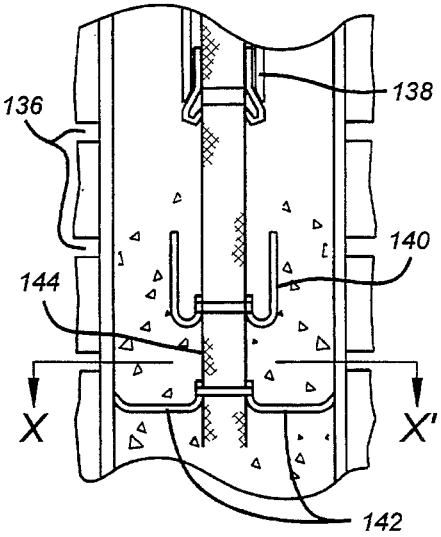
FIG. 11 is an illustration of the operation of the packing diaphragms.
Figure 9:
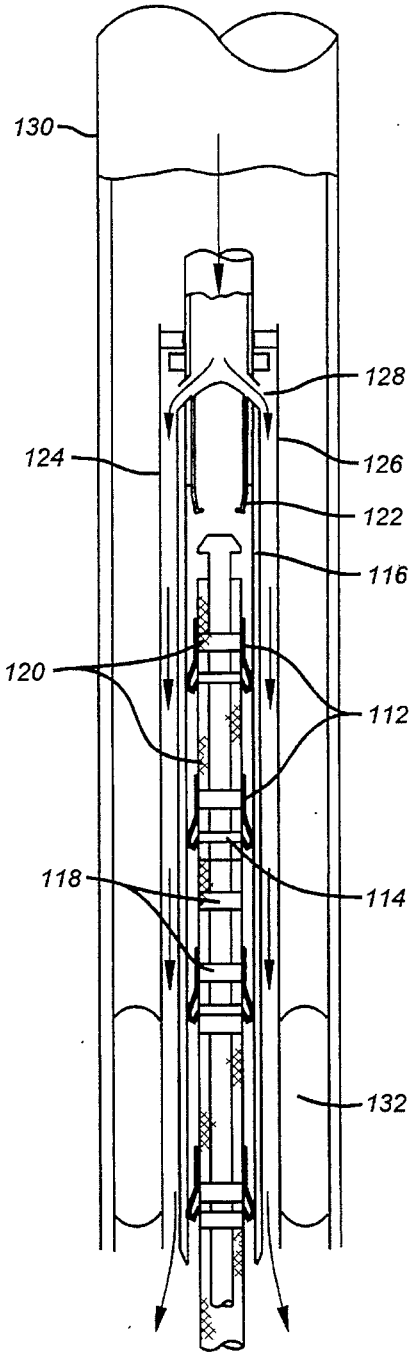
FIG. 9 is an embodiment including a washpipe and inner seals as well as the packing diaphragms.

Still another embodiment of the invention, illustrated in FIGS. 9 and 11, includes packing diaphragms 112. These diaphragms are secured at intervals to screen 120 by means of bands 114. As shown in FIG. 10, the diaphragms are made up of multiple flexible elements 134.

As seen from FIG. 11, in operation the diaphragms are initially held compactly against the outer surface of the screen 144, folded so that the flexible elements lie extended in the direction of the sleeve's axis. A flexible sheath 138 holds the diaphragms in this collapsed position. The sheath is attached to the inside of the sleeve (not shown), and moves in tandem with the sleeve. As the sleeve and sheath 138 move upward, lower diaphragms 140 are released and deploy to cover the annular cross-section between the screen and the casing, extending in a direction essential perpendicular to the screen's axis. The deployed packing diaphragms 142 may completely or only partially cover the annular screen-casing cross-section, and may be used with any other packing assembly in the manner shown to benefit annular packing. The diaphragms restrict downward flow through the packed material thus increasing pressures and facilitating automatic upward movement of the sleeve.

The procedure in using the method of the present invention involves first placing the screen 84 in the position shown in FIG. 6 and latching it to packer 96 in the conventional manner. Thereafter, the shear pins 30 are broken with an upward pull on the tubing which is at upper end 88. With the inflatable member 74 initially in the lowermost position as shown in FIG. 7, fluids are pumped into inflatable member 74, causing it to inflate due to the backpressure presented from openings 90. That same fluid is also the carrier fluid for the granular material, as represented by arrows 92 and 94. The granular material flows through the inflatable member 74 and is kept out of seal elements 76 because each one has a screened opening 86. Upon sufficient deposition of granular material through and adjacent to the lowermost perforations 98, which are shown exposed in FIG. 7, the inflatable member 74 is repositioned and the process continues. Repositioning may occur by upward surface control and/or by pressure created due to the packing process. Repositioning may occur with the elements inflated and pumping continuous in some cases. Alternatively, the flow can be temporarily interrupted, which results in partial deflation of inflatable member 74. Upon its subsequent repositioning, the flow is resumed, causing inflatable member 74 to reinflate in a higher position than that shown in FIG. 7. Sequentially, the granular material is placed outside of the entire perforated interval and screen 84 from the packer 96 on up to the topmost perforation 100, as shown in FIG. 7. It should be noted that the inflatable member 74 can be made of a sufficiently resilient material so that it can be shifted in an inflated position. This may require that the perforations 98 and 100 have been properly deburred. Due to the multiplicity of seals envisioned in the preferred embodiment, even a malfunction in one of the sealing elements 76 will not preclude the apparatus A from performing its intended function. As before, the deposition of the granular material, as indicated by arrow 94, could also act with the flowing fluid to raise the pressure below the inflatable member 74 but above the packer 96. This can result in an unbalanced force on the inflatable member 74, which can urge it in an upward position. If this occurs, it is not a problem since it indicates that the area around the exposed perforations is sufficiently packed. It is, in fact, desirable since the unbalanced force may be utilized to automatically lift the sleeve to expose additional, higher perforations for packing as packing of lower perforations is completed. To this end, the net unbalanced force may be augmented by providing a restriction in the return flow path as previously described. Furthermore, as previously stated, there is sufficient flexibility in the inflatable member 74 so that it can withstand pressure pushes upward while it is inflated without substantial adverse impact on its function.

The inflatable member 74 can be made of a material compatible with the wellbore environment including the temperature and fluids expected to be present. At present, the preferred material for some applications, based on the criteria given above, is neoprene. Alternatively, nitrile rubber can be used.

Figure 12A:
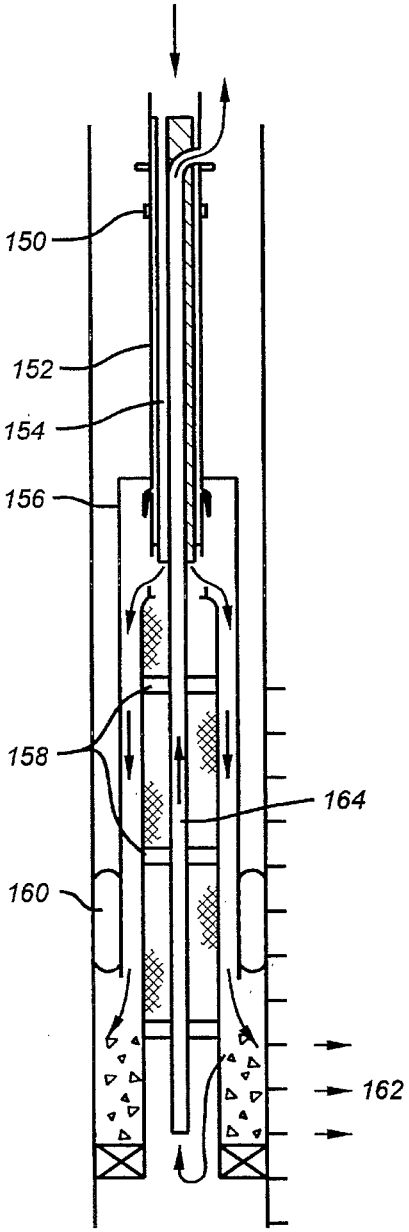
FIGS. 12*a–c* are an embodiment including a washpipe and a return flow path.
Figure 12B:
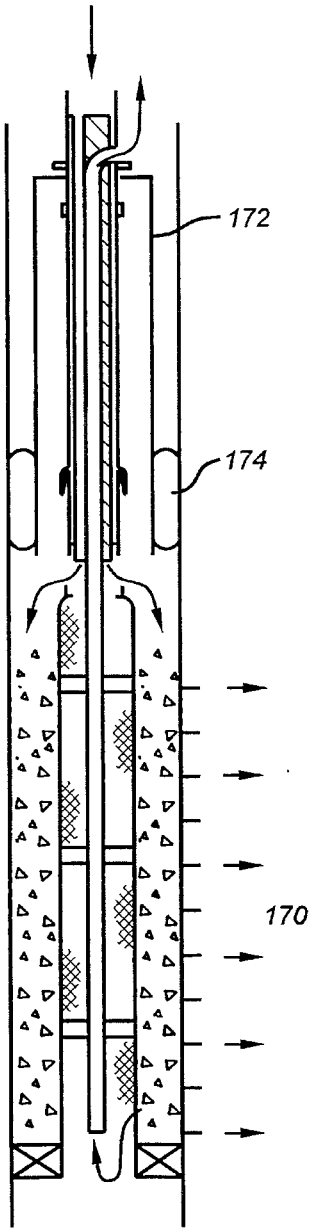
Figure 12C:
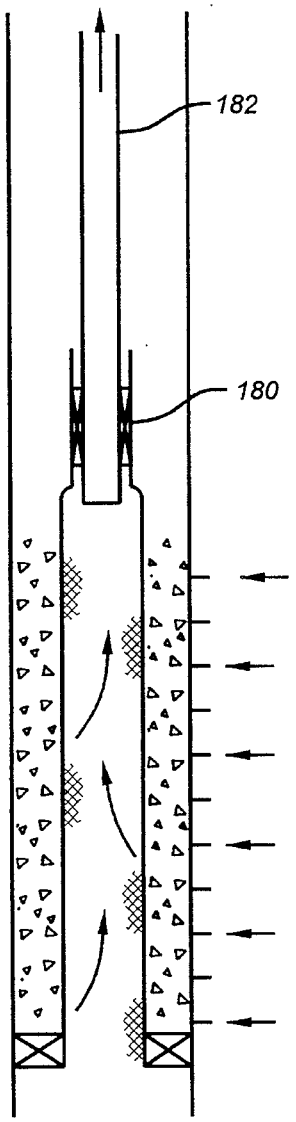

The embodiment shown in FIGS. 12*a* through 12*c* includes a washpipe and a return flow path. In FIG. 12*a*, the packing assembly has been lowered as previously described and packing is progressing with only the lowermost perforations 162 in the interval exposed. Latch 150 is provided to limit conduit 156. A crossover assembly 152 and wash pipe seal assembly or assemblies 158 are provided to separate the slurry flow path 154 from the return flow path 164. Conduit 172 rises automatically in response to pressure developed under conduit seals 174 during packing, eventually reaching the latch. Once packing is complete, the packing assembly is removed allowing production tubing 182 and production seals 180 to be placed. An additional packer may also be run on the production tubing in a conventional manner.

Applicant has developed an apparatus A and method which allows for more effective gravel packing by providing various alternative ways to ensure that the granular material is deposited from the bottom up, starting from the packer in the wellbore. The apparatus A and the method have thus overcome a problem in prior designs caused by bridging or otherwise incomplete deposition and packing of the granular material when it is deposited from the top down.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for gravel packing between a bottom and a top of a perforated interval in a wellbore, comprising:

a screen; and a sleeve circumscribing and movably mounted with respect to said screen, creating an annular flowpath therebetween, said sleeve movable between at least a first position, where said sleeve is interposed between said screen and at least some of the perforations, and a second position, where due to said movement said sleeve is interposed between said screen and fewer perforations than in said first position.

2. The apparatus of claim 1 further comprising a seal member mounted to said sleeve for sealing between said sleeve and the wellbore.

3. The apparatus of claim 1 wherein fluids bearing granular material can be pumped through said flowpath to deposit said granular material, said sleeve moving automatically between said positions in response to pressure developed by said pumping.

4. The apparatus of claim 2 further comprising a partially restricted flow path within said screen.

5. The apparatus of claim 4 wherein said restricted flow path comprises:

a washpipe disposed within said screen, forming a washpipe-screen annulus therebetween; and at least one seal fixed to said washpipe sealing at least part of the cross-section of said washpipe-screen annulus.

6. The apparatus of claim 5 wherein said washpipe seal fully seals said washpipe-screen annulus cross-section.

7. The apparatus of claim 3 further comprising a partially restricted flow path within said screen comprising:

a washpipe disposed within said screen forming a washpipe-screen annulus therebetween; and at least one washpipe seal fixed to said washpipe and sealing the cross-section of said washpipe-screen annulus.

8. The apparatus of claim 2 further comprising:

at least one flexible diaphragm mounted to said screen, said diaphragm movable between a collapsed position adjacent to and substantially parallel to said screen and a deployed position extending outward from and substantially perpendicular to said screen, said diaphragm covering at least a portion of the cross-section of the annulus between said screen and the wellbore when in said deployed position;

a sheath initially holding said diaphragm in said collapsed position and moving in tandem with said sleeve.

9. The apparatus of claim 7 further comprising:

at least one flexible diaphragm mounted to said screen, said diaphragm movable between a collapsed position adjacent to and substantially parallel to said screen and a deployed position extending outward from and substantially perpendicular to said screen, said diaphragm covering at least a portion of the cross-section of the annulus between said screen and the wellbore when in said deployed position;

a sheath initially holding said diaphragm in said collapsed position and moving in tandem with said sleeve.

10. An apparatus for gravel packing between a bottom and a top of a perforated interval in a wellbore comprising:

a screen positioned in said perforated interval;

at least one flexible diaphragm mounted to said screen, said diaphragm movable between a collapsed position adjacent to and substantially parallel to said screen and a deployed position extending outward from and substantially perpendicular to said screen, said diaphragm covering at least a portion of the cross-section of the annulus between said screen and the wellbore when in said deployed position; and a sheath initially holding said diaphragm in said collapsed position and moving in tandem with said sleeve.

11. The apparatus of claim 10 wherein said sheath is movable between a first position, where said sheath holds said diaphragm in said collapsed position, and a second position, where due to said movement said diaphragm is released to move to said deployed position.

12. The apparatus of claim 10 wherein said diaphragm is biased toward movement to said deployed position.

13. The apparatus of claim 12 further comprising:

a sleeve comprising two conduits of different diameters, one disposed within the other, creating an annular flow path therebetween, said screen circumscribing, attached to, and moving in tandem with said sheath, said screen movable between a first position, where said screen and said sheath are inter. between said screen and the perforations so that only some of the perforations in the interval are exposed, and a second position, where due to said movement of said sleeve additional perforations are exposed; and a seal member mounted to said sleeve for sealing between said sleeve and the wellbore.

14. The apparatus of claim 12 further comprising a partially restricted flow path within said screen.

15. The apparatus of claim 14 wherein said restricted flow path comprises:

a washpipe disposed within said screen, forming a washpipe-screen annulus therebetween; and at least one seal fixed to said washpipe sealing at least part of the cross-section of said washpipe-screen annulus.

16. The apparatus of claim 15 wherein said washpipe seal fully seals said washpipe-screen annulus cross-section.

17. A method of gravel-packing a perforated interval in a wellbore, comprising:

setting a screen at a desired depth;

providing a shiftable sleeve relatively movable with respect to the screen, said sleeve interposing between said screen and the perforations so that some of the perforations are exposed;

pumping granular material over said screen and beyond said sleeve to be deposited in and around said exposed perforations;

automatically shifting said sleeve to expose additional higher perforations; and continuing deposition of granular material to cover additional perforations in the interval.

18. The method of claim 17 further comprising:

providing a seal comprising an inflatable member mounted to said sleeve for contact with the wellbore.

19. The method of claim 17 further comprising the step of providing a restricted return flow path.

20. The method of claim 19 further comprising the step of providing at least one flexible diaphragm on said screen, said diaphragm initially held collapsed adjacent to and substantially parallel to said screen by a sheath moving in tandem with said sleeve and released to extend outward from and substantially perpendicular to said screen when said sleeve and sheath are shifted, said diaphragm covering at least a portion of the cross-section of the annulus between said screen and the wellbore.

* * * * *